US005554086A

United States Patent [19]

Habing et al.

[11] Patent Number: 5,554,086

[45] Date of Patent: Sep. 10, 1996

[54] LEG PRESS EXERCISE APPARATUS

[75] Inventors: Theodore G. Habing, Long Beach; Douglas J. Habing, Manhattan Beach, both of Calif.

[73] Assignee: Pacific Fitness Corporation, Cypress, Calif.; a part interest

[21] Appl. No.: 309,879

[22] Filed: Sep. 23, 1994

[51] Int. Cl.[6] ..... A63B 21/062; A63B 21/068; A63B 23/04

[52] U.S. Cl. ..... 482/137; 482/96; 482/100; 482/101; 482/134; 482/142

[58] Field of Search ..... 482/51, 72, 96–98, 482/94, 133, 100–103, 135–139, 142, 907, 908, 95, 134, 99; 601/33–35, 98

[56] References Cited

U.S. PATENT DOCUMENTS

| | | | |
|---|---|---|---|
| 3,219,341 | 11/1965 | Weinstein | 482/96 |
| 3,446,503 | 5/1969 | Lawton | 482/96 |
| 4,043,552 | 8/1977 | Kerkonian | 482/96 |
| 4,176,836 | 12/1979 | Coyle | 482/96 |
| 4,377,281 | 3/1983 | Jesernig et al. | 482/96 |
| 4,500,089 | 2/1985 | Jones | 482/100 |
| 4,717,148 | 1/1988 | Brewer | 482/72 |
| 4,872,670 | 10/1989 | Nichols | 482/135 |
| 4,915,378 | 4/1990 | Abrahamian et al. | 482/137 |
| 5,108,095 | 4/1992 | Nichols | 482/137 |
| 5,116,297 | 5/1992 | Stonecipher | 482/97 |
| 5,184,992 | 2/1993 | Banks | 482/98 |
| 5,256,125 | 10/1993 | Jones | 482/98 |
| 5,322,489 | 6/1994 | Webb et al. | 482/137 |
| 5,342,269 | 8/1994 | Huang et al. | 482/137 |
| 5,356,358 | 10/1994 | Chen | 482/72 |
| 5,411,458 | 5/1995 | Giust | 482/101 |

FOREIGN PATENT DOCUMENTS

| | | | |
|---|---|---|---|
| 2210191 | 9/1973 | Germany | 482/72 |
| 6007475 | 1/1994 | Japan | 482/98 |

*Primary Examiner*—Richard J. Apley
*Assistant Examiner*—Victor K. Hwang
*Attorney, Agent, or Firm*—Blakely, Sokoloff, Taylor & Zafman

[57] ABSTRACT

A compact attachment for a multi-station exercise machine conveniently couples to a low pull station and therefore utilizes the weight stack or other resistance mechanism of the exercise machine. The attachment is designed for performing leg press and other lower limb exercises. The attachment has a frame on which a pair of foot pads are mounted. A seat for the operator of the attachment is suspended from the frame by a pair of parallel pivoting arms so that the seat remains in a relatively constant attitude throughout the exercise stroke. The invention may be alternatively embodied as a stand alone device utilizing free weights as a means for providing exercise resistance.

31 Claims, 3 Drawing Sheets

LEG PRESS EXERCISE APPARATUS

FIELD OF THE INVENTION

This invention relates to the field of exercise equipment, and particularly to an apparatus for performing a leg press exercise, which apparatus may be attached to a conventional multi-station exercise machine.

BACKGROUND OF THE INVENTION

Many different types of exercise machines have been developed for strengthening a user's muscles. One such type of machine is a leg press. A typical leg press exercise machine has a seat mounted on a frame and a push plate that can move relative to the frame. The user sits in the seat and pushes the plate with his legs such that the plate moves from a rest position to an extended position. The push plate is coupled to some type of exercise resistance means, which provides a reactive force to the pushing motion of the user. The exercise resistance means is typically a weight stack, a selectable portion of which is lifted when the push plate is moved forward toward the extended position. The weight stack is typically coupled to the push plate by a cable/pulley assembly. There are many different types of dedicated leg press exercise machines available on the market today. Such machines have their own weight stack or other source of exercise resistance and are generally not practical for home use due to the amount of space that must be dedicated to performing a single exercise.

Multi-station, or so called "universal", exercise machines are very popular for home use since many different exercises can be performed on a single apparatus. Machines of this type generally have a single weight stack that may be coupled to the various exercise stations by means of a cable/pulley system. Relatively few of these machines include an integrated leg press station, although this is sometimes offered as an optional accessory. Generally speaking, leg press stations on a multi-station exercise machine utilize a moving push plate as in dedicated leg press machines. In order to provide a bio-mechanically correct exercise, a relatively complicated linkage and rigging system is required. As a result, such devices are relatively expensive which limits their marketability. Some simpler leg press stations are also available. For example, the Parabody Model 062 is available with a pendulum style leg press station. The user's seat is mounted on a pendulum arm with an overhead pivot point. A fixed push plate is mounted on the frame. Exercise resistance from the machine's weight stack is communicated by means of a cable attached to the user's seat. Such a pendulum style machine fails to provide a bio-mechanically correct exercise due to the forward rotation of the user's body relative to the push plate. Furthermore, due to the inherent design limitations of such a machine, the exercise resistance at the end of the exercise stroke will be too low if the starting resistance is properly set and, conversely, the starting resistance will be too high if the ending resistance is properly adjusted.

SUMMARY OF THE INVENTION

The present invention provides a compact leg press attachment for a multi-station exercise machine. The attachment conveniently couples to a low pull station and therefore utilizes the weight stack or other resistance mechanism of the exercise machine. The leg press attachment has a frame on which a pair of foot pads are mounted. A seat for the operator of the attachment is suspended from the frame by a pair of parallel pivoting arms so that the seat remains in a relatively constant attitude throughout the exercise stroke.

The invention may be alternatively embodied as a stand alone device utilizing free weights as a means for providing exercise resistance. In this embodiment, the seat is preferably suspended for movement along a steeper path of travel so that a greater proportion of the combined mass of the operator and free weights is communicated as exercise resistance.

In either embodiment, the invention may be alternatively constructed using an arcuate track upon which the operator's seat rides. The track is preferably curved to be upwardly convex so that the operator's torso rotates slightly rearwardly during the course of the exercise stroke in opposition to the direction of rotation of the operator's thighs.

DETAILED DESCRIPTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known exercise methods and devices are omitted so as to not obscure the description of the present invention with unnecessary detail.

Figure 1:
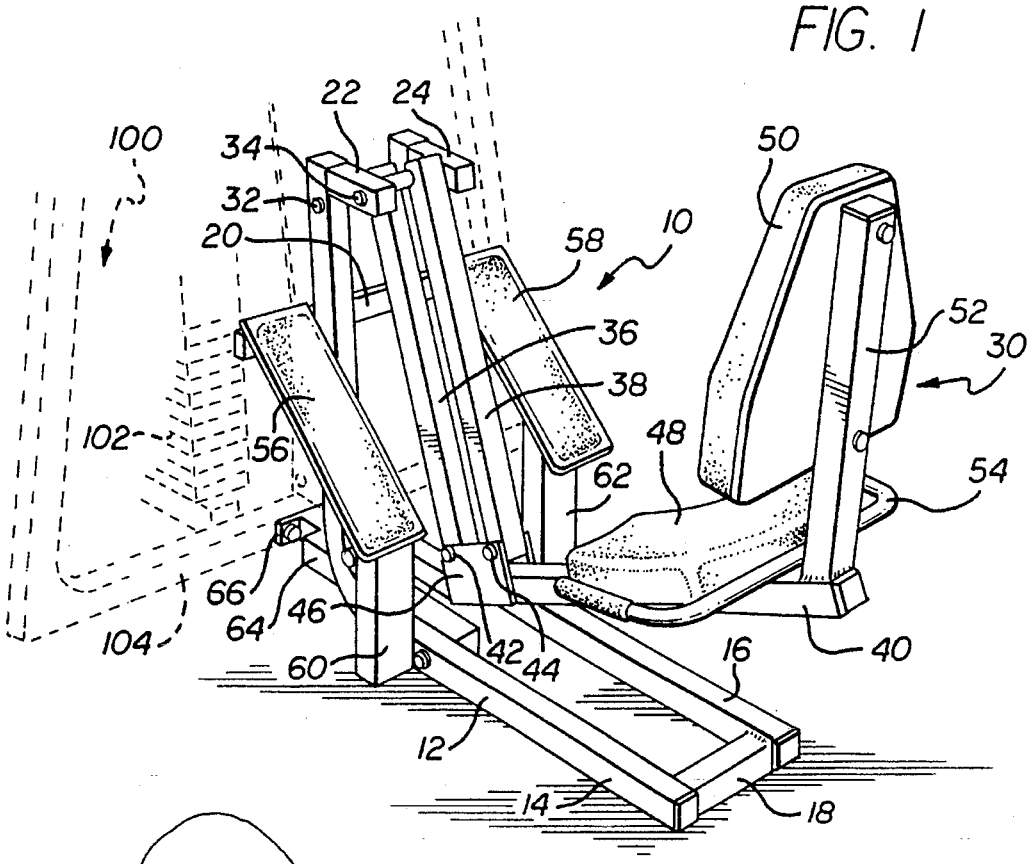
FIG. 1 is a perspective view of a leg press attachment constructed in accordance with the present invention.

FIG. 1 is a perspective view of an exercise apparatus 10 constructed in accordance with the present invention. Apparatus 10 has a frame 12 comprising identical longitudinal members 14 and 16. The longitudinal members are joined at the rear by cross member 18 and at the front by cross member 20. Longitudinal members 14 and 16 are generally L-shaped with horizontal legs to support apparatus 10 on a floor or other surface and upstanding vertical legs disposed forwardly. Rearwardly facing extensions 22 and 24, respectively, are secured at the top ends of the vertical legs.

A seat assembly 30 is suspended from frame 12 by a pair of swing members 36, 38. Forward swing member 36 is coupled to pivot 32 on the vertical legs of longitudinal members 14 and 16, whereas rear swing member 38 is coupled to pivot 34 on extension members 22 and 24. Swing members 36 and 38 are coupled to longitudinal seat support member 40 at pivots 42 and 44, respectively, which are supported by brackets 46. Swing members 36 and 38 are approximately equal in length and are mounted in an approximately parallel relationship. Varying the lengths of swing members 36, 38 and/or the distance between pivot pairs 32, 34, or 42, 44 would allow for various arcuate paths of the seat assembly.

Seat assembly 30 includes a lower seat cushion 48 secured to longitudinal seat support member 40 and a back support cushion 50 secured to back support member 52. A handle bar 54 is welded or otherwise secured to longitudinal seat support member 40 to provide a convenient hand grip for the operator during use of apparatus 10. Foot pads 56 and 58 are provided for placement of the operator's feet during use of apparatus 10. The foot pads 56 and 58 are secured to frame cross member 20 and vertical support posts 60 and 62, respectively.

The structural members of apparatus 10 are preferably fabricated from square and rectangular section steel tubing. All fixed joints are preferably welded, although bolts or other suitable fasteners could be used if desired.

Apparatus 10 is used in association with an exercise apparatus 100, which is shown in partial phantom outline in the figures. Apparatus 100 may be any one of a variety of multi-station or "universal" exercise machines that provide a plurality of exercise stations coupled to a weight stack 102 or other suitable means for providing exercise resistance. Apparatus 10 is designed to be coupled to a low pull exercise station of apparatus 100 as will be more fully described below. Apparatus 10 is attached to frame 104 of apparatus 100 by means of forward extension member 64, which is bolted or welded to longitudinal frame member 14. Extension member 64 includes a flange 66, which is bolted to frame member 104 of apparatus 100.

Figure 2:
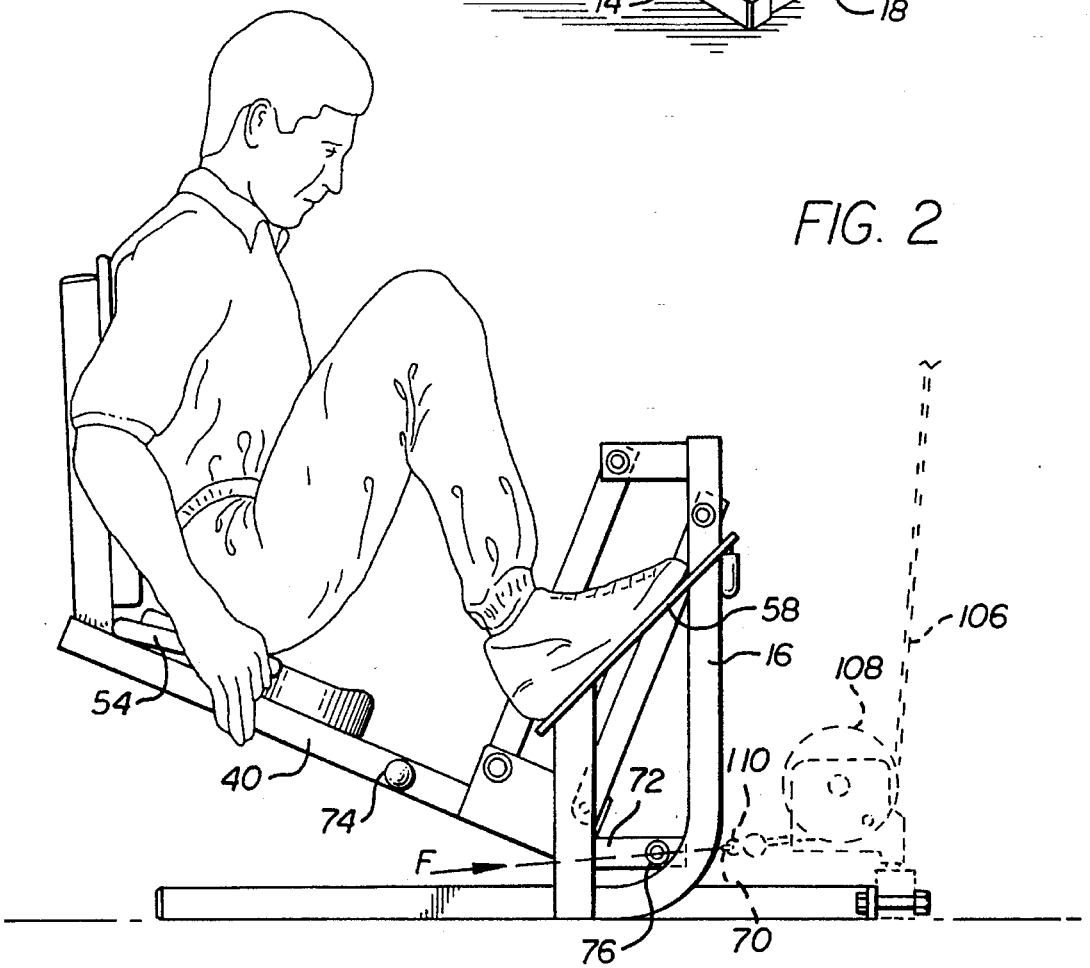
FIG. 2 is an elevation view of the apparatus of FIG. 1 showing an operator in an exercise starting position.

Referring now to FIG. 2, the starting position for performing a leg press exercise with apparatus 10 is illustrated. The operator is seated on seat cushion 48 with his feet placed on foot pads 56, 58. A cable 106 of exercise apparatus 100 is guided around low pulley 108. As is conventional for exercise machines such as apparatus 100, cable 106 terminates at a snap hook 110. Snap hook 110 is coupled to loop 70, which is secured to an extension member 72. Member 72 is an angled piece of steel tubing that telescopes within longitudinal seat support member 40. The position of extension member 72 relative to longitudinal seat support member 40 is selectable by the operator by means of pop pin 74, which engages one of a plurality of holes (not shown) in extension member 72. Pop pin 74 is a spring loaded pin of the type that is widely used for providing manual adjustments on exercise machines. A stop roller 76 is disposed on extension member 72 for cooperating engagement with longitudinal frame member 16. It will thus be appreciated that seat assembly 30 will be positioned more distantly from foot pads 56, 58 as extension member 72 is positioned forwardly with respect to longitudinal seat support member 40. The exercise starting position can therefore be adjusted to vary the extent to which the operator's hip and knee joints are bent. Once the desired exercise resistance and starting position have been selected, the operator begins the exercise by pushing against foot pads 56, 58.

Figure 3:
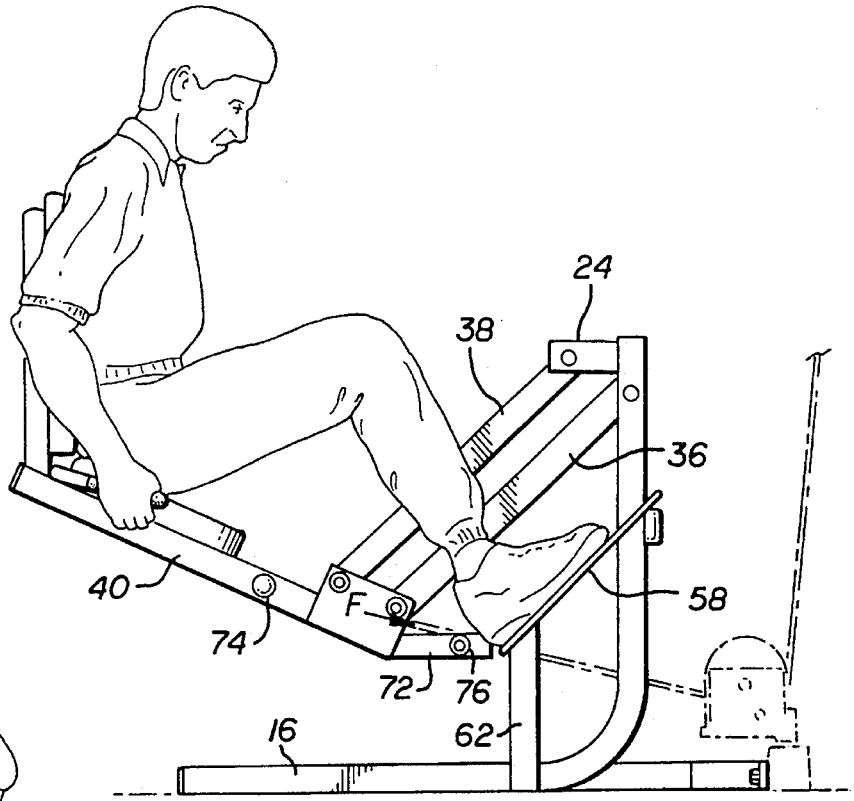
FIG. 3 illustrates an intermediate position of an exercise.

FIG. 3 illustrates apparatus 10 at the mid-point of an exercise stroke. The operator's legs are partially extended, forcing seat assembly 30 to move rearwardly and upwardly. It is important to note that the attitude of seat assembly 30 with respect to the horizontal remains virtually constant as a result of the parallel arrangement of members 36 and 38. However, vertical displacement of seat assembly 30 takes place, which contributes a portion of the operator's body weight to the exercise resistance.

Figure 4:
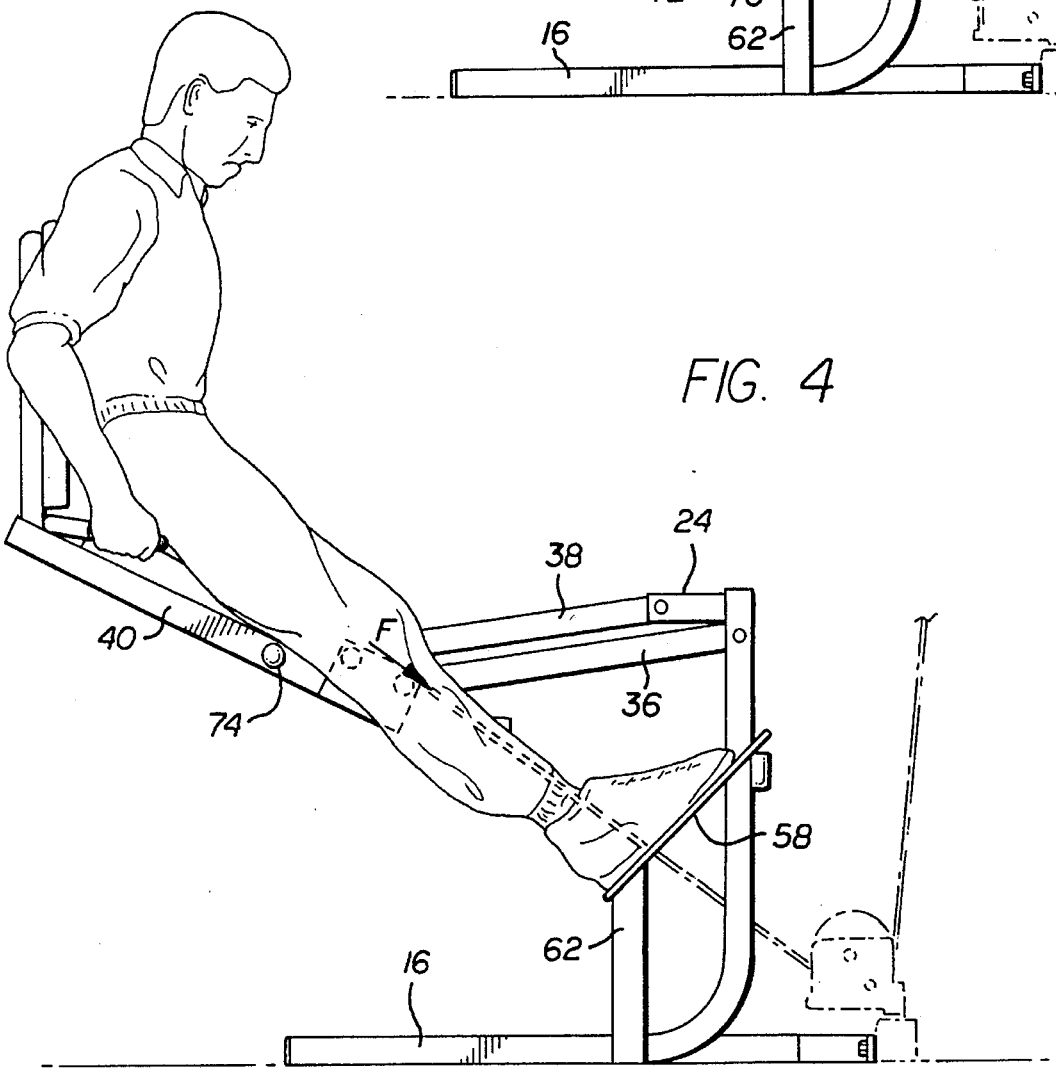
FIG. 4 shows the exercise stroke at full extension.

FIG. 4 illustrates the end of the exercise stroke at which point the operator's legs are fully extended. Here again, it should be observed that the attitude of seat assembly 30 with respect to the horizontal has not changed appreciably. It should be observed that the direction of force transmitted along cable 106 (indicated by arrow F) has transitioned from a direction lying below pivots 42,44 in FIG. 2 to a direction lying above these points in FIG. 4. This creates a moment that tends to counteract the moment due to the cantilevered position of the operator's body mass about pivots 42, 44. The net result is an increasing exercise resistance communicated to the operator during the course of the exercise stroke. This increasing resistance curve counteracts the increasing mechanical leverage of the operator's legs as they are extended. The operator therefore experiences a relatively constant effective level of resistance throughout the exercise.

Such constant effective resistance is an improvement over a simple pendulum arrangement wherein the resistance curve, without considering bio-mechanical effects, is constant. With a constant resistance curve, the resistance tends to be too high at the beginning of the exercise where leverage of the leg joints is at a minimum. The result can be excessive stress placed on the knee joint. Conversely, at the end of the exercise stroke, the resistance tends to be too low where the leverage of the leg joints is at a maximum and may be overcome by the operator's momentum. This can result in over-extension of the knee joints.

A typical pendulum style leg press as is known in the prior art inherently reduces the amount of pivoting about the operator's hip joint since the operator's torso rotates forwardly, i.e., in the same direction of rotation as the operator's thighs. Such corresponding rotation of the torso and thighs means that there is less rotation about the hip joint than with a conventional squat or fixed seat leg press. Thus, for an equivalent exercise stroke, a pendulum style leg press results in greater rotation of the operator's knee joint. Consequently, more stress and pressure is placed on the knee joint and less is placed on the hip joint. Since the largest muscles of the body are associated with the hip joint, these receive less exercise than do the smaller muscles associated with the knee joint.

In the various embodiments of the present invention, the operator's torso is maintained at a more constant angle with respect to the foot pads, and therefore rotation at the operator's hip joint is not reduced at the expense of greater rotation at the knee joint. By preserving the range of motion of the hip joint, the operator experiences a more constant resistance curve and a more natural lower body exercise, similar to squats but with greater hip joint motion. It should be observed that the pivot points of the apparatus can be located so that seat assembly 30, and thus the operator's torso, rotates slightly rearwardly as the exercise progresses, i.e., in a direction opposite to rotation of the operator's thigh. This affords even greater rotation about the operator's hip joint and therefore provides a more effective exercise for the gluteus and hamstring muscles which are associated with the hip joint.

Figure 5:
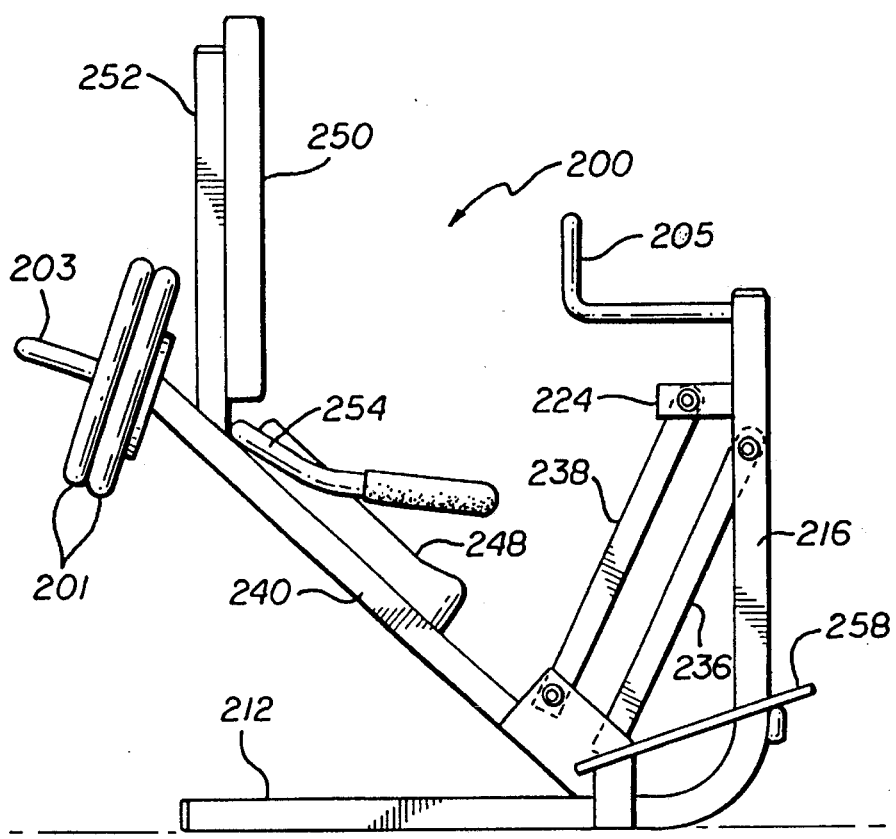
FIG. 5 is a side elevation view of an alternative embodiment of the present invention configured for a stand alone use.

FIG. 5 illustrates an alternative embodiment of the invention. Apparatus 200 is constructed as a stand alone device, but is otherwise substantially similar in construction to apparatus 10. Corresponding parts of the two devices are identified with reference numerals having the same last two digits. It will be seen that longitudinal seat support member 240 is inclined at a considerably steeper angle than is support member 40 of device 10. This is done so that a greater proportion of the operator's body weight will contribute to the exercise resistance. Additional exercise resistance is afforded by weight plates 201 that are placed over pin 203 at the rear of seat support member 240. Weight plates 201 may be conventional disc shaped plates of the type that are widely used with barbells. An assist handle 205 is preferably provided at the top of frame 212 for use by the operator while entering and leaving the exercise position.

Figure 6:
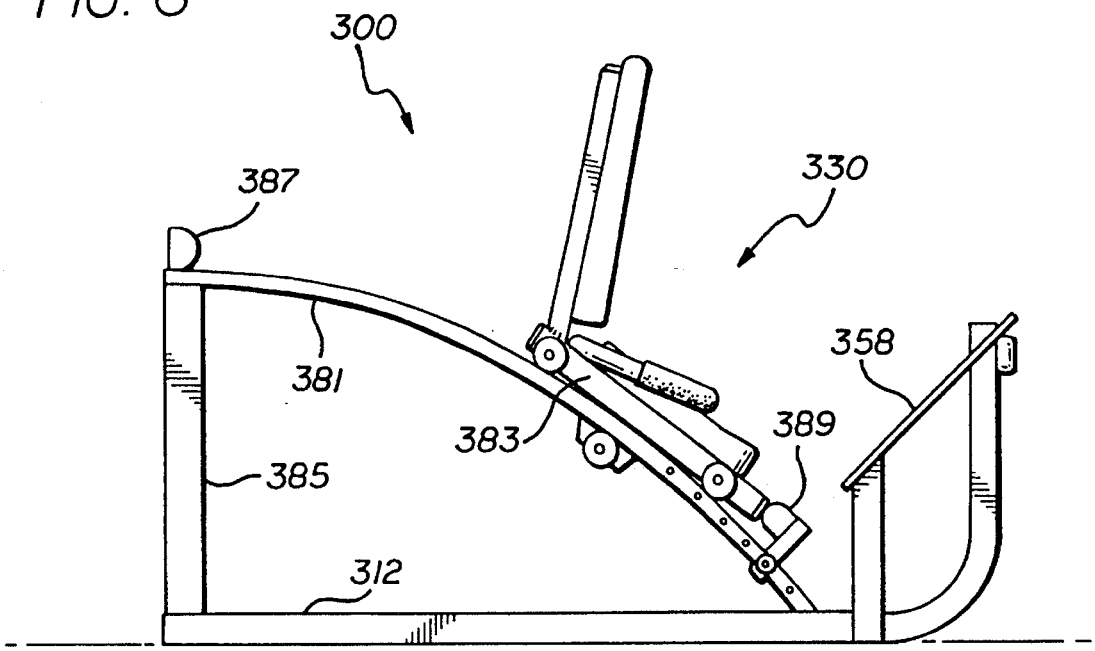
FIG. 6 is a side elevation view of another alternative embodiment of the present invention.

FIG. 6 illustrates a further alternative embodiment of the present invention. Here again, structural elements corresponding to those of the previously described embodiment are indicated by the last two digits of the reference numerals. Apparatus 300 differs from the previously described embodiments in that seat assembly 330 is located along an arcuate track 381 by a carriage 383. Track 381 is attached to frame 312 at its forward end and to upright frame member 385 at the rearward end. A stop 387 limits rearward travel of the carriage and seat assembly. Forward stop 389 is adjustably positionable along track 381 to provide a convenient adjustment of the rest/starting position. In this embodiment, the path of motion followed by seat assembly 330 during the course of the exercise is convex upwardly. This produces a rearward rotation of the operator's torso and, as explained above, a consequent increase in emphasis on the gluteus and hamstring muscles. It should be apparent that this embodiment of the invention may be constructed either as an attachment to a conventional multi-station exercise machine or as a stand-alone leg press exercise device.

Throughout this discussion, the invention has been described in terms of a device for performing a leg press exercise. It will be recognized that the same apparatus is also useful for performing other lower limb exercises. For example, toe raises may be performed within a very limited range of motion to extend and thereby exercise the calf muscles. Therefore, although the invention is described as a leg press device, it is not to be construed as limited in this regard.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An apparatus for performing a seated leg press exercise comprising:

a frame;

means fixed to the frame for supporting a user's feet;

a seat movable with respect to the frame for supporting the user in a seated position;

linkage means pivotally coupled to the frame at a first location and the seat at a second location below the first location, said linkage means for locating the seat along a path of motion relative to the frame such that the torso supporting means remains in an approximately constant attitude relative to horizontal at every position along the path of motion; and means, coupled directly to the seat, for providing a user selectable exercise resistance.

2. The apparatus of claim 1 wherein said means for providing a user selectable exercise resistance comprises a user selectable weight coupled to the seat.

3. The apparatus of claim 1 wherein said means for providing a user selectable exercise resistance comprises a weight stack.

4. The apparatus of claim 3 further comprising a cable coupled between the weight stack and the seat.

5. The apparatus of claim 1 wherein said linkage means comprises a first support arm pivotally coupled at a first end thereof to the frame and at a second end thereof to the seat.

6. The apparatus of claim 5 wherein said linkage means further comprises a second support arm pivotally coupled at a first end thereof to the frame and at a second end thereof to the seat.

7. The apparatus of claim 1 wherein said path of motion is inclined relative to horizontal.

8. A leg press attachment for an exercise machine, the exercise machine including means for providing an exercise resistance and an exercise station operatively coupled to the exercise resistance means, said attachment comprising:

a frame;

at least one footpad supported on the frame;

a support for supporting a user of the attachment in a seated position;

linkage means pivotally coupled to the frame at a first location and the support at a second location below the first location for locating the support along a path of motion relative to the frame such that the support remains in an approximately constant attitude relative to horizontal at every position along the path of motion;

means for coupling the support to the exercise resistance means at a low pull station of the exercise machine.

9. The leg press attachment of claim 8 wherein the frame includes a frame member disposed to be fastened to the exercise machine.

10. The leg press attachment of claim 8 wherein the support comprises a seat cushion and a back support cushion.

11. The leg press attachment of claim 8 wherein the linkage means comprises a pair of support arms independently pivotally coupled at respective first ends to the frame and independently pivotally coupled at respective second ends to the support.

12. The leg press attachment of claim 8 wherein the support has a rest position along the path of motion and said leg press attachment further comprises user operable means for adjusting the rest position.

13. The leg press attachment of claim 12 wherein said rest position adjusting means comprises a stop secured to said support for cooperating engagement with the frame so as to limit the path of motion at one end thereof.

14. An apparatus for performing a seated leg press exercise comprising:

a frame;

means fixed to the frame for supporting a user's feet;

a seat for supporting the user in a seated position;

first and second linkage arms pivotally coupled at respective first ends thereof to the frame at a first location and at respective second ends thereof to the seat at a second location below the first location such that the seat is moveable with respect to the foot supporting means; and means, coupled directly to the seat, for providing a user selectable exercise resistance.

15. The apparatus of claim 14 wherein said means for providing a user selectable exercise resistance comprises a user selectable weight coupled to the seat.

16. The apparatus of claim 14 wherein said means for providing a user selectable exercise resistance comprises a weight stack.

17. The apparatus of claim 16 further comprising a cable coupled between the weight stack and the seat.

18. The apparatus of claim 14 wherein the first and second linkage arms are substantially parallel.

19. A leg press attachment for an exercise machine, said exercise machine including means for providing an exercise resistance and an exercise station operatively coupled to the exercise resistance means, said attachment comprising:

a frame;

at least one footpad supported on the frame;

a support for supporting a user of the attachment in a seated position;

first and second linkage arms pivotally coupled at respective first ends thereof to the frame at a first location and at respective second ends thereof to the support at a second location below the first location such that the support is movable with respect to the footpad;

means for coupling the support to the exercise resistance means at a low pull station of the exercise machine.

20. The leg press attachment of claim 19 wherein the frame includes a frame member disposed to be fastened to the exercise machine.

21. The leg press attachment of claim 19 wherein the support comprises a seat cushion and a back support cushion.

22. The leg press attachment of claim 19 wherein the support has a rest position and said leg press attachment further comprises user operable means for adjusting the rest position.

23. The leg press attachment of claim 22 wherein said rest position adjusting means comprises a stop secured to said support for cooperating engagement with the frame so as to limit movement of the support.

24. The apparatus of claim 19 wherein the first and second linkage arms are substantially parallel.

25. An apparatus for performing a seated leg press exercise comprising:

a frame;

a seat support member;

a seat coupled to the seat support member for supporting a user in a seated position;

means for supporting the user's feet when the user is seated in the seat such that the user's feet are substantially forward of the user's torso;

first and second linkage arms pivotally coupled to the frame at respective first pivots, said first and second linkage arms also pivotally coupled to the seat support member at respective second pivots, each of the respective second pivots being at a lower elevation than a corresponding respective first pivot;

means coupled directly to the seat support member for providing a user selectable exercise resistance.

26. The apparatus of claim 25 wherein the first and second linkage arms are approximately equal in length.

27. The apparatus of claim 25 wherein the first and second linkage arms are coupled to the frame and the seat support member in an approximately parallel relationship.

28. The apparatus of claim 25 wherein the means for providing a user selectable exercise resistance comprises a cable.

29. A leg press attachment for an exercise machine, the exercise machine including means for providing an exercise resistance at a low pull station, said attachment comprising:

a frame;

a seat support member;

a seat coupled to the seat support member for supporting a user in a seated position;

means for supporting the user's feet when the user is seated in the seat such that the user's feet are substantially forward of the user's torso;

first and second linkage arms pivotally coupled to the frame at respective first pivots, said first and second linkage arms also pivotally coupled to the seat support member at respective second pivots, each of the respective second pivots being at a lower elevation than a corresponding respective first pivot;

means for coupling the seat support member to the low pull station of the exercise machine.

30. The leg press attachment of claim 29 wherein the first and second linkage arms are approximately equal in length.

31. The leg press attachment of claim 29 wherein the first and second linkage arms are coupled to the frame and the seat support member in an approximately parallel relationship.

* * * * *